US008410872B2

(12) United States Patent
Uhm et al.

(10) Patent No.: US 8,410,872 B2
(45) Date of Patent: Apr. 2, 2013

(54) LINE FILTER FORMED ON DIELECTRIC LAYERS

(75) Inventors: Man Seok Uhm, Daejeon (KR); Changsoo Kwak, Daejeon (KR); Youn Sub Noh, Daejeon (KR); In Bok Yom, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 294 days.

(21) Appl. No.: 12/823,198

(22) Filed: Jun. 25, 2010

(65) Prior Publication Data

US 2011/0148548 A1 Jun. 23, 2011

(30) Foreign Application Priority Data

Dec. 21, 2009 (KR) ..... 10-2009-0127965

(51) Int. Cl.
*H01P 1/203* (2006.01)
*H01P 7/08* (2006.01)

(52) U.S. Cl. ..... 333/205; 333/235

(58) Field of Classification Search ..... 333/202, 333/203, 204, 205, 219, 235
See application file for complete search history.

(56) References Cited

U.S. PATENT DOCUMENTS

| | | | | | |
|---|---|---|---|---|---|
| 3,359,513 | A * | 12/1967 | Kelley | 333/161 |
| 3,391,356 | A * | 7/1968 | Bolljahn et al. | 333/203 |
| 4,757,285 | A * | 7/1988 | Krause | 333/203 |
| 5,014,024 | A * | 5/1991 | Shimizu et al. | 333/203 |
| 5,418,509 | A * | 5/1995 | Piirainen | 333/203 |
| 5,446,430 | A * | 8/1995 | Yamanaka et al. | 333/202 |
| 5,621,365 | A * | 4/1997 | Yamazaki et al. | 333/204 |
| 5,654,681 | A * | 8/1997 | Ishizaki et al. | 333/204 |
| 6,005,455 | A * | 12/1999 | Lindell et al. | 333/134 |
| 6,265,954 | B1 * | 7/2001 | Krause | 333/204 |
| 6,522,225 | B2 | 2/2003 | Liang et al. | |
| 6,566,988 | B2 * | 5/2003 | Muzutani et al. | 333/219 |
| 6,686,817 | B2 * | 2/2004 | Zhu et al. | 333/205 |
| 6,798,317 | B2 * | 9/2004 | Silk et al. | 333/185 |
| 7,561,012 | B2 * | 7/2009 | Fukunaga | 333/204 |
| 7,573,356 | B2 | 8/2009 | Kawai et al. | |

FOREIGN PATENT DOCUMENTS

| | | | |
|---|---|---|---|
| JP | 2000-357903 | A | 12/2000 |
| KR | 2001-0009213 | A | 2/2001 |
| KR | 2007-0003598 | A | 1/2007 |
| KR | 2009-0080761 | A | 7/2009 |

* cited by examiner

*Primary Examiner* — Benny Lee
*Assistant Examiner* — Gerald Stevens
(74) *Attorney, Agent, or Firm* — Rabin & Berdo, P.C.

(57) ABSTRACT

Provided is a line filter. The line filter includes a plurality of dielectric layers stacked one another, a plurality of line resonator each comprising transmission lines on at least two of the dielectric layers, and a tuning unit adjusting a binding amount and resonance frequency of the line resonators. Since the line filter includes at least one line resonator on at least two stacked dielectric layers, the integration can be easily realized. Further, since the line filter can be adjusted even after the line filter is manufacture, the line filter has an excellent frequency property. Since the line filter is realized on the plurality of the dielectric layers, the frequency band can be widened.

3 Claims, 6 Drawing Sheets

LINE FILTER FORMED ON DIELECTRIC LAYERS

CROSS-REFERENCE TO RELATED APPLICATIONS

This U.S. non-provisional patent application claims priority under 35 U.S.C. §119 of Korean Patent Application No. 10-2009-0127965, Dec. 21, 2009, the entire contents of which are hereby incorporated by reference.

BACKGROUND OF THE INVENTION

The present invention disclosed herein relates to a line filter formed on a plurality of dielectric layers.

A comb-line filter composed of the form of transmission lines is a kind of a band pass filter used in a microwave band. The band pass filter includes a plurality of line resonators between an input port line and an output port line. Each of the line resonators includes a plurality of transmission lines. The transmission lines resonators have the same structure as each other. The line resonators are spaced apart from each other by a predetermined distance in response to a frequency response property. In addition, each of the line resonators is grounded at one side thereof.

SUMMARY OF THE INVENTION

The present invention provides a line filter that is advantageous in integration and can improve performance by tuning.

Embodiments of the present invention provide line filters including: a plurality of dielectric layers stacked one another; a plurality of line resonator each comprising transmission lines on at least two of the dielectric layers; and a tuning unit adjusting a binding amount and resonance frequency of the line resonators.

In some embodiments, transmission lines of each of the line resonators may be formed on the respective dielectric layers.

In other embodiments, each of the line resonators may have an electrical length equal to or less than 90°.

In still other embodiments, one of the transmission lines of each of the line resonator may be electrically connected to a ground through a via and the via is located at a first end of the corresponding transmission line.

In still yet other embodiments, the tuning unit may be provided above the transmission lines with a dielectric layer interposed between the tuning unit and the transmission lines.

In still further other embodiments, the tuning unit may include at least one tuning element, and the tuning element may be provided on the transmission line on a top surface of an uppermost one of the dielectric layers.

In even other embodiments, the tuning element may be formed between the transmission lines on the top surface of the uppermost one of the insulation layer.

In even further embodiments, the tuning element may be provided on the transmission line on a top surface of an uppermost one of the dielectric layers, and a direction in which the transmission line on the top surface of the uppermost one of the dielectric layers is arranged may be opposite to a direction in which other transmission lines are arranged.

In even yet other embodiments, the tuning element may be provided in the form of a screw.

In even still yet other embodiments, the tuning element may be coupled to a housing of the line filer.

In even further other embodiments, the line resonators may have an identical grounding direction.

In still yet other embodiments, at least one of the line resonators may have a different grounding direction from other line resonators.

In other embodiments of the present invention, line filters include a plurality of line resonators; and a tuning unit for adjusting a binding amount and resonance frequency between the line resonators, wherein each of the line resonators includes a first transmission line arranged in a first direction on a top surface of a first dielectric layer and electrically connected to a ground through a first via through the first dielectric layer; and a second transmission line arranged in a second direction opposite to the first direction on a top surface of a second dielectric layer and electrically connected to the first transmission line through a second via through the second dielectric layer.

In some embodiments, the first direction may be directed from a first end of the first transmission line, to which the first via is connected, to a second end of the first transmission line, to which the second via is connected.

In other embodiments, the first direction may be directed from a first end of the first transmission line, to which the first via is connected, to a second end of the first transmission line, to which the second via is connected.

In still other embodiments of the present invention, line filters include a plurality of first line resonators; a plurality of second line resonators; and a tuning unit for adjusting a binding amount and resonance frequency between a first pair of first and second line resonators and a second pair of first and second line resonators, which is adjacent to the first pair, wherein each of the first line resonators includes a first transmission line arranged in a first direction on a top surface of a first dielectric layer and electrically connected to a ground through a first via through the first dielectric layer; and a second transmission line arranged in a second direction opposite to the first direction on a top surface of a second dielectric layer and electrically connected to the first transmission line through a second via through the second dielectric layer, wherein each of the second line resonators includes a third transmission line arranged in the first direction on a top surface of a third dielectric layer and electrically connected to the ground through a third via through the third dielectric layer; and the first direction is directed from a first end of the first transmission line, to which the first via is connected, to a second end of the first transmission line, to which the second via is connected.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Figure 1:
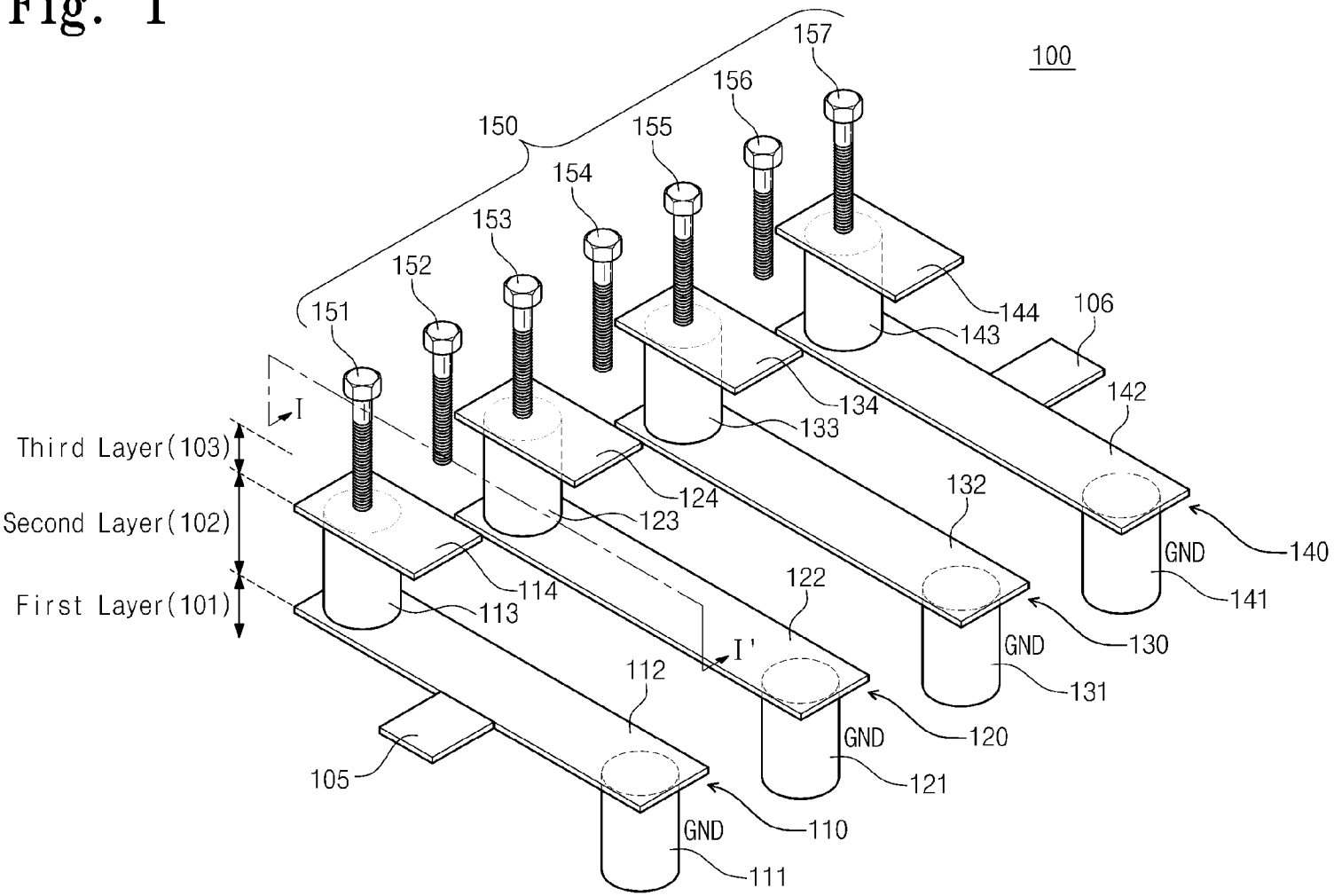
FIG. 1 is a view of a line filter according to an embodiment.

FIG. 1 is a view of a line filter according to an embodiment. Referring to FIG. 1, a line filter 100 includes an input port line 105, an output port line 106, a plurality of line resonators 110, 120, 130, and 140, and a tuning unit 150. The line resonators 110, 120, 130, and 140 are formed on a plurality of dielectric layers 101 and 102 that are stacked.

The input port line 105 receives signals, and the output lines 106 outputs signals passing through the line filter 100. The line resonators 110, 120, 130, and 140 are located between the input and output port lines 105 and 106. In FIG. 1, four line resonators 110, 120, 130, and 140 are shown. However, the present invention is not limited to this. That is, at least one line resonator may be provided.

Each of the line resonators 110, 120, 130, and 140 is formed on two dielectric layers 101 and 102 that are stacked. In this embodiment, the layers 101 and 102 may be dielectric layers.

Each of the line resonators 110, 120, 130, and 140 resonates at a desired frequency. In addition, the line resonators 110, 120, 130, and 140 are spaced apart from each other by a predetermined distance in response to a responsive property.

The first line resonator 110 includes a first line 112 on a top surface of the first dielectric layer 101 and a second line 114 on a top surface of the second dielectric layer 102. Here, the first line 112 is electrically connected to a ground (GND) through a first via 111. The first via 111 is formed through the first dielectric layer 101, and the ground (GND) is located on an undersurface of the first dielectric layer 101. In addition, the first and second lines 112 and 114 are interconnected through a second via 113.

A whole electrical length of the first and second lines 112 and 114 is 90° or less. The electrical length can be obtained by the multiplication of a wave number of a signal transmitted through a transmission medium with the physical length of the whole lines. The electrical length related with the wavelength may be expressed by a measuring unit such as radian or angle. Namely, a whole length of the first and second lines 112 and 114 is ¼ or less of the wavelength λ of the signal input to the input port line 105. In this embodiment, the first line resonator 110 may has an electrical length of about 30-70°.

The second line resonator 120 includes a third line 122 on a top surface of the first dielectric layer 101 and a fourth line 124 on a top surface of the second dielectric layer 102. The third line 122 is electrically connected to the ground (GND) through a third via 121. In addition, the third and fourth lines 122 and 124 are electrically interconnected through a fourth via 123. A whole electrical length of the third and fifth lines 122 and 124 is equal to or less than 90°. In this embodiment, the second line resonator 120 may has an electrical length of about 30-70°.

The third line resonator 130 includes a fifth line 132 on a top surface of the first dielectric layer 101 and a sixth line 134 on a top surface of the second dielectric layer 102. Here, the fifth line 132 is electrically connected to the ground (GND) through a fifth via 131. The fifth and sixth lines 132 and 134 are electrically interconnected through a sixth via 133. A whole length of the fifth and sixth lines 132 and 134 is equal to or less than 90°. In this embodiment, the third line resonator 130 may has an electrical length of about 30-70°.

The fourth line resonator 140 includes a seventh line 142 on a top surface of the first dielectric layer 101 and a eighth line 144 on a top surface of the second dielectric layer 102. The seventh line 142 is electrically connected to the ground (GND) through a seventh via 141. In addition, the seventh and eighth lines 142 and 144 are electrically interconnected through an eighth via 143. A whole electrical length of the seventh and eighth lines 142 and 144 is equal to or less than 90°. In this embodiment, the fourth line resonator 140 may has an electrical length of about 30-70°.

The line resonators 110, 120, 130, and 140 shown in FIG. 1 are formed on two layers 101 and 102. However, the present invention is not limited to this. The resonators may be formed on two or more layers.

The tuning unit 150 is formed on the respective line resonators 110, 120, 130, and 140 to adjust a binding amount and a resonating frequency between the line resonators 110, 120, 130, and 140. The tuning unit 150 includes a plurality of tuning elements 151-157. As shown in FIG. 1, the tuning elements 151-157 may be metal tuning screws. Alternatively, the tuning elements 151-157 may be dielectric tuning screws.

To adjust the resonant frequency, the tuning unit 150 including the tuning elements 151-157 is operated as a capacitor. The tuning unit 150 adjusts a gap between the lines on an uppermost layer among the dielectric layers and the tuning elements 151-157 so that the resonance occurs at the desired frequency. For example, as the tuning element 151 is getting closer to the second line 114, the capacity of the capacitor increases. Therefore, the electrical length of the first line resonator 110 increases.

In addition, the tuning elements 151 and 157 are formed on a third dielectric layer 103 on the second dielectric layer 102. Here, the third dielectric layer 103 may be formed of a dielectric including a dielectric material. Alternatively, the third dielectric layer 103 may be an air layer.

The tuning elements 151, 153, 155, and 157 are formed on the lines 114, 124, 134, and 144 on the uppermost one 103 of the line resonators 110, 120, 130, and 140. In addition, the tuning elements 152, 154, and 156 are formed between the lines 114, 124, 134, and 144 on the uppermost one 103 of the line resonators 110, 120, 130, and 140.

The line filter 100 of this embodiment is formed with the dielectric layers 101 and 102 that are stacked one another and thus the integration can be advantageously realized. In addition, the line filter 100 of this embodiment can be adjusted through the tuning elements 151-157 even after the line filter 100 is manufactured, thereby having an excellent frequency property. Further, since the line filter 100 of this embodiment is formed with the insulation layers 101 and 102 that are stacked one another to increase a binding amount, the usable frequency band can be widened.

In addition, the line filter 100 of the present invention includes the tuning unit 150 to adjust the binding amount and resonance frequency between the adjacent line resonators. Accordingly, in the line filter 100, there is no need to equalize the lengths of the adjacent lines formed on a same layer. As a result, the line filter can be optimally realized.

Figure 2:
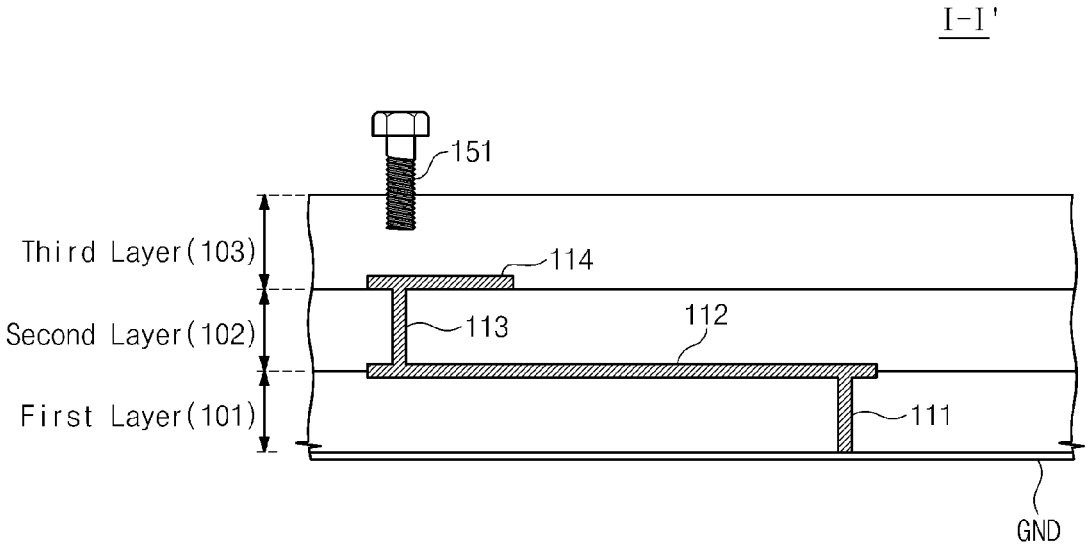
FIG. 2 is a cross-sectional view taken along line I-I' of FIG. 1.

FIG. 2 is a cross-sectional view taken along line I-I' of FIG. 1. Referring to FIG. 2, the line resonator 110 includes the first via 111, the first line 112, the second via 113, and the second line 114.

The first via 111 is formed through the first dielectric layer 101 to electrically connect the first line 112 to the ground (GND). Here, the ground (GND) may exist on an entire undersurface of the first dielectric layer 101.

The second via 112 is formed through the second dielectric layer 102 and connects the first line 112 to the second line 114. Here, a total electrical length of the first and second lines 112 and 114 is 90° or less.

As shown in FIG. 2, the third dielectric layer 103 is formed above the line resonator 110. The tuning element 151 disposed in the third dielectric layer 103 adjust a binding amount of the line resonator 110 and the adjacent line resonators 120, 130, and 140.

Figure 3:
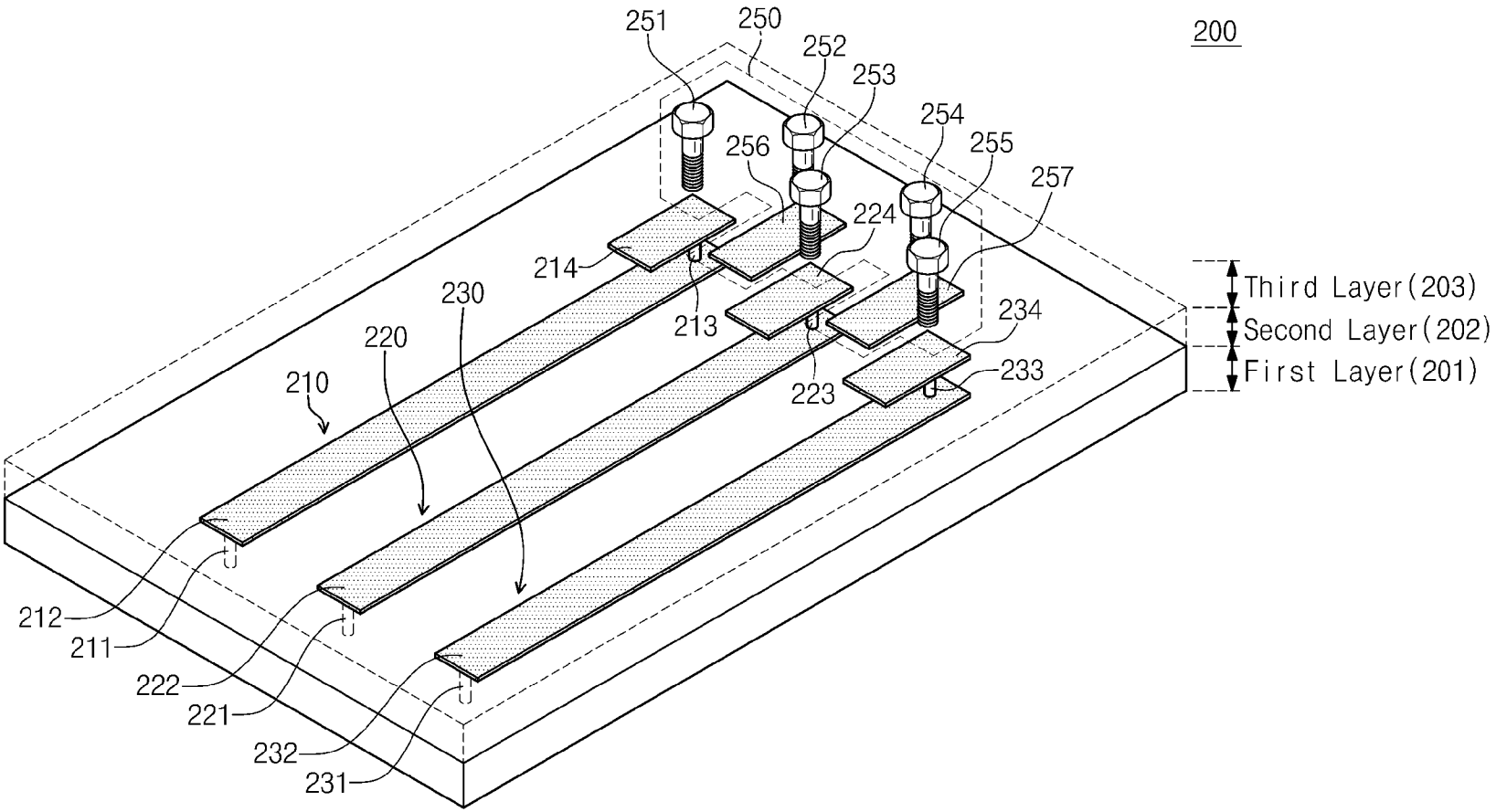
FIG. 3 is a perspective view of a line filter according to another embodiment.

FIG. 3 is a perspective view of a line filter according to another embodiment. Referring to FIG. 3, a line filter 200 includes first, second, and third line resonators 210, 220, and 230 on two dielectric layers 201 and 202 and a tuning unit 250 adjusting a binding amount and a resonance frequency of the first, second, and third line resonators 210, 220, and 230.

The line filter 200 of this embodiment is a comb-line filter. The comb-line filter is a kind of a band pass filter used in a microwave band. The line filter 200 includes first, second, and third line resonators 210, 220, and 230 that are formed in an identical structure. The first line resonator 210 includes first and second transmission lines 212 and 214. The second line resonator 220 includes third and fourth transmission lines 222 and 224. The third line resonator 230 includes fifth and sixth transmission lines 232 and 234.

In addition, the first, second, and the third line resonators 210, 220, and 230 are spaced apart from each other by a predetermined distance in response to a desired frequency response property. Further, one side of each of the first, second, and third line resonators 210, 220, and 230 is grounded. In the first, second, and third line resonators 210, 220, and 230, first ends of the first, third, and fifth transmission lines 212, 222, and 232 are connected to a ground GND. Meanwhile, the tuning unit 250 is disposed on second ends of the first, third, and fifth transmission lines 212, 222, and 232.

In the first line resonator 210, the first transmission line 212 is electrically connected to the ground (GND) through the first via 211. The second transmission line 214 is connected to the first transmission line 212 through a second via 213. Here, the first via 211 is formed through the first dielectric layer 201 at the first end of the first transmission line 212. The second via 213 is formed through the second dielectric layer 202 at a second end of the first transmission line 212. That is, the second via 213 is located at the second end of the first transmission line 212 and a first end of the second transmission line 214.

Hereinafter, a direction from the first end of the first transmission line 212 to the second end of the first transmission line 212 will be referred to as "first direction," and a direction from the first end of the second transmission line 214 to a second end of the second line 214 will be referred to as "second direction." Here, the first direction is opposite to the second direction. An advancing direction of the first transmission line 212 is the first direction and an advancing direction of the second transmission line 214 is the second direction. The advancing directions mean arrangement directions.

In the second line resonator 220, the third transmission line 222 is electrically connected to the ground (GND) through a third via 221. The fourth transmission line 224 is electrically connected to the third transmission line 222 through a fourth via 223. Here, the third via 221 is formed through the first insulation layer 201 at a first end of the third transmission line 222. In addition, the fourth via 223 is formed through the second dielectric layer 202 at a second end of the third transmission line 222. Further, an advancing direction of the third transmission line 222 is opposite to an advancing line of the fourth transmission line 224. That is, the advancing direction of the third transmission line 222 is the first direction and the advancing direction of the fourth transmission line 224 is the second direction.

In the third line resonator 230, the fifth transmission line 232 is electrically connected to the ground (GND) through a fifth via 231. The sixth transmission line 234 is electrically connected to the fifth transmission line 232 through a sixth via 233. Here, the fifth via 231 is formed through the first dielectric layer 201 at a first end of the fifth transmission line 232. Further, the fifth via 233 is formed through the second dielectric layer 202 at a second end of the fifth transmission line 232. In addition, an advancing direction of the fifth transmission line 232 is opposite to an advancing direction of the sixth transmission line 234. That is, the advancing direction of the fifth transmission line 232 is the first direction and the advancing direction of the sixth transmission line 234 is the second direction.

The tuning unit 250 includes first, second, third, fourth and fifth tuning elements 251, 252, 253, 254, and 255 and seventh and eighth transmission lines 256 and 257. The tuning unit 250 adjusts the binding amount and resonance frequency of the first, the second and third line resonators 210, 220, and 230.

The first tuning element 251 is located above on the second transmission line 214 of the first line resonator 210. The second tuning element 252 is located above the seventh transmission line 256 between the second transmission line 214 of the first line resonator 210 and the fourth transmission line 224 of the second line resonator 220. The third tuning element 253 is located above the fourth transmission line of the second line resonator 220. The fourth tuning element 254 is located above the eighth transmission line 257 between the fourth transmission line 224 of the second line resonator 220 and the sixth transmission line 234 of the third line resonator 230. The fifth tuning element 255 is located above the sixth transmission line 234 of the third line resonator 230.

In FIG. 3, the line filter 200 is comprised of three line resonators 210, 220, and 230. However, the present invention is not limited to this. The line filter 200 may be comprised of at least two line resonators.

In addition, in FIG. 3, the seventh and eighth transmission lines 256 and 257 are formed between the line resonators 210, 220, and 230, and the second and fourth tuning elements 252 and 254 are located above the seventh and eighth transmission lines 256 and 257. This is for enabling the line filter 200 to be tuned by locating the transmission lines 256 and 257 between the other transmission lines as the gaps between the transmission lines are very narrow. However, there is no need to dispose the tuning elements on the transmission lines. That is, the line filter may include the tuning elements between the line resonators even when there is no transmission line under the tuning elements. For example, the tuning elements 252 and 254 may be provided even when the seventh and eighth transmission lines 256 and 257 are omitted.

Generally, since the gaps between the transmission lines are very narrow, the tuning elements should be made in a small size. However, there are realistically many difficulties in making the tuning elements in the small size. Therefore, according to this embodiment, the tuning point may be varied in a desired direction rather than a direction opposite to a grounding direction. For example, the grounding direction and the tuning point can be desirably set.

Figure 4:
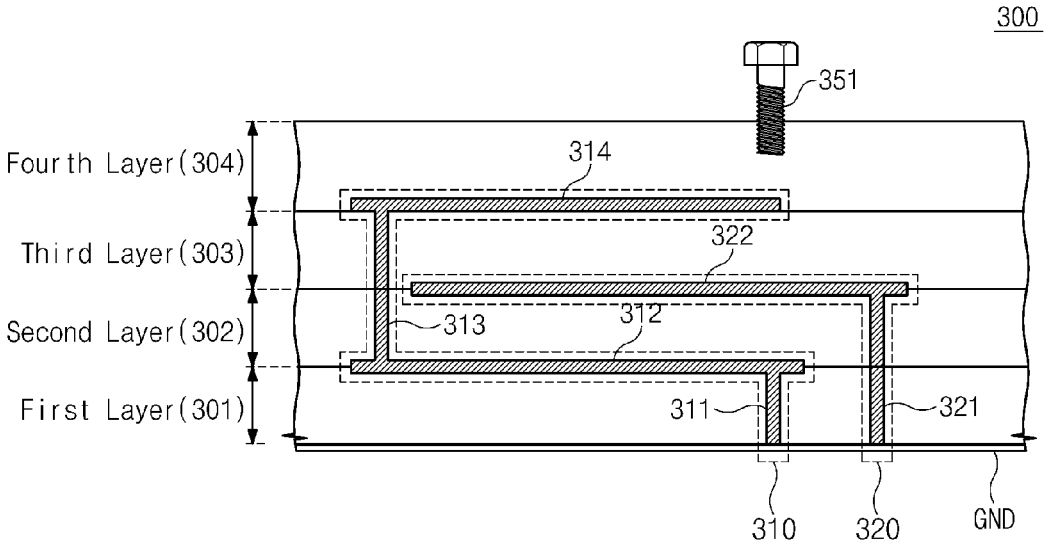
FIG. 4 is a schematic view of a line filter according to another embodiment.

FIG. 4 is a schematic view of a line filter according to another embodiment. Referring to FIG. 4, a line filter 300 includes first and second line resonators 310 and 320 on first, second, and third insulation layers 301, 302, and 303 and a tuning element 351.

The first line resonator 310 includes a first via 311, a first transmission line 312, a second via 312, and a second transmission line 314. The first via 311 is formed through the first dielectric layer 301 and electrically connects the first transmission line 312 to the ground (GND). The first via 311 is located at a first end of the first transmission line 312. The first transmission line 312 is located on a top surface of the first dielectric layer 301. The second via 313 is formed through the second and third dielectric layers 302 and 303 and electrically connects the first transmission line 312 to the second transmission line 314. The second via 313 is located at a second end of the first transmission line 312. The second transmission line 314 is located on a top surface of the third dielectric layer 303.

Hereinafter, a direction from the first end of the first transmission line 312 to the second end of the first transmission line 312 will be referred to as "first direction," and a direction from a first end of the second transmission line 314 to a second end of the third transmission line 314 will be referred to as "the second direction." Accordingly, an advancing direction of the first transmission line 312 is the first direction and an advancing direction of the second transmission line 314 is the second direction. Here, the first direction is opposite to the second direction.

The second line resonator 320 includes the third via 321 and a third transmission line 322. The third via 321 is formed through the first dielectric layer 301 and electrically connects the third transmission line 322 to the ground (GND). The third transmission line 322 is located on a top surface of the second dielectric layer 302. Here, an advancing direction of the third transmission line 322 is the first direction.

The tuning element 351 is formed on the second transmission line 314 and located at a first end of the second transmission line 314 having a second end connected to the second via 313. That is, the tuning element 351 is formed on the first via 311 connected to the ground (GND).

According to the line filter 300 of this embodiment, even when the grounding directions of the line resonators 310 and 320 are determined, the tuning point can be properly varied in a desired direction by properly arranging the transmission lines on the stacked dielectric layers 301, 302, and 303.

In the line filter 300 of FIG. 4, two line resonators 310 and 320 are provided. However, the present invention is not limited to this. That is, the line filter 300 may further include additional line resonators that are realized in the same structure as the line resonators 310 and 320.

In the line filter 300 of FIG. 4, one tuning element 351 is provided. However, the present invention is not limited to this. The line filter 300 may further include additional tuning elements that have a same structure as the tuning element 351. At this point, the tuning element adjusts a binding amount between a first pair of first and second line resonators and a second pair of first and second line resonators, which is adjacent to the first pair.

The line resonators shown in FIGS. 1 to 4 have the same grounding direction as each other. However, the present invention is not limited to this. At least one of the line resonators may have a different grounding direction from others.

Figure 5:
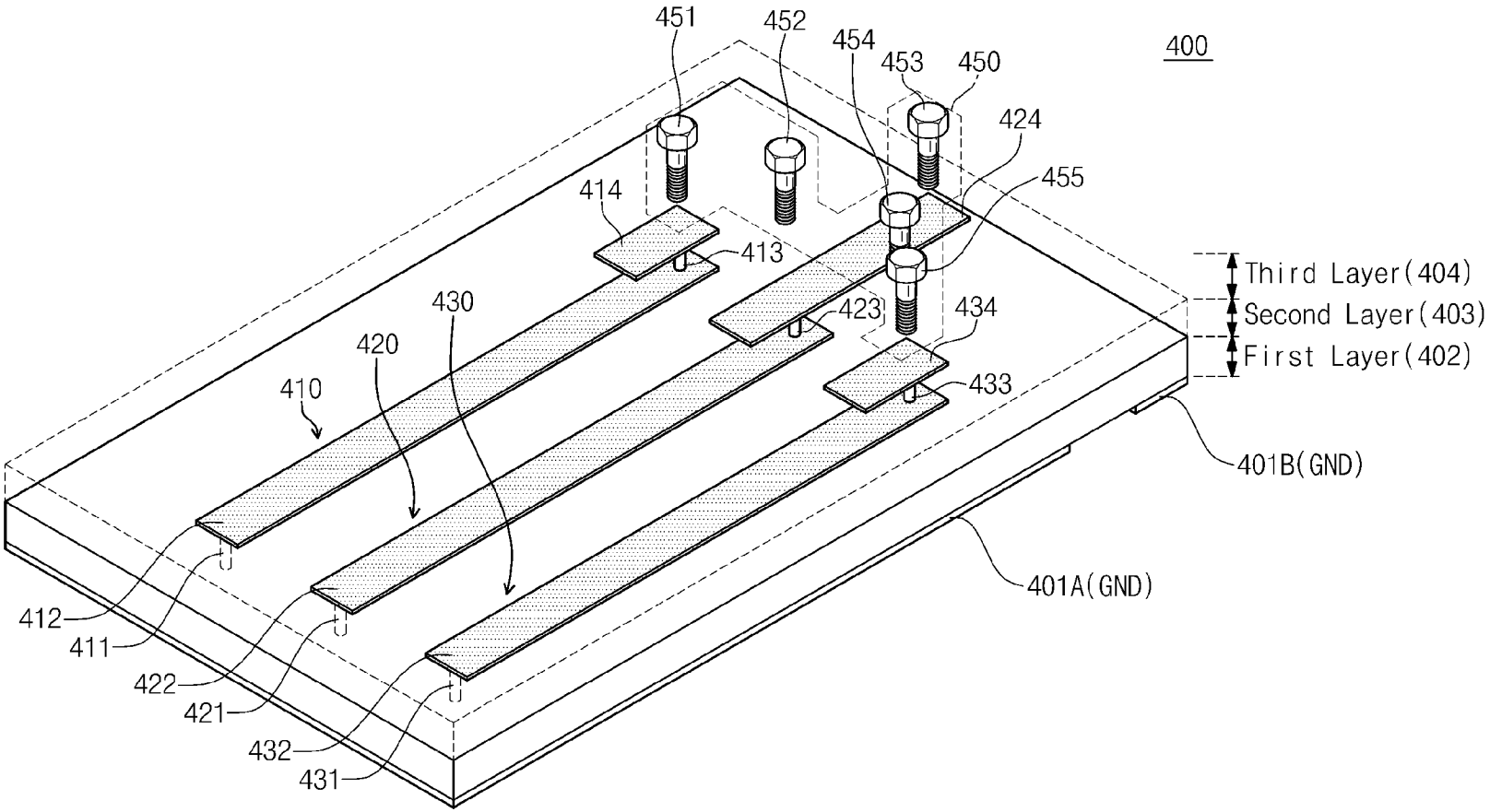
FIG. 5 is a perspective view of a line filter 400 according to another embodiment.

FIG. 5 is a perspective view of a line filter 400 according to another embodiment. Referring to FIG. 5, the line filter 400 includes first and second grounds 401A and 401B, first, second, and third line resonators 410, 420, and 430 on first and second dielectric layers 402 and 403 that are stacked one another, and a tuning element 450.

The first line resonator 410 includes a first transmission line 412 electrically connected to the first ground 401A through a first via 411 and the second transmission line 414 electrically connected to the first transmission line 412 through a second via 413. Here, the first via 411 is formed through the first dielectric layer 402 and located at a first end of the first transmission line 412. The second via 413 is formed through the second dielectric layer 403 and located at a second end of the first transmission line 412.

The second line resonator 420 includes a third transmission line 422 electrically connected to the first ground 401A through a third via 421, and a fourth transmission line 424 electrically connected to the third transmission line 422 through a fourth via 423. Here, the third via 421 is formed through the first dielectric layer 402 and located at a first end of the third transmission line 422.

Hereinafter, a direction from the first end of the first transmission line 412 to the second end of the first transmission line 412 will be referred to as "first direction," and a direction from the first end of the second transmission line 414 to the second end of the second transmission line 414 will be referred to as "second direction." Here, the first direction is directed toward the second ground 401B and the second direction is directed toward the first ground 401A. At this point, an advancing direction of the fourth transmission line 424 is the first direction and an advancing direction of the second transmission line 424 is not directed toward the first ground 401A but the second ground 401B.

Meanwhile, the first ground 401A and the second ground 401B are electrically separated from each other. On the other hand, the fourth via 423 is formed through the second dielectric layer 403 and located at a second end of the transmission line 422.

The third line resonator 430 includes a fifth transmission line 432 electrically connected to the first ground 401A through a fifth via 431 an a sixth transmission line 434 electrically connected to the fifth transmission line 432 through a sixth via 433. Here, the fifth via 431 is formed through the first dielectric layer 402 at a first end of the fifth transmission line 432. Meanwhile, the sixth via 433 is formed through the second dielectric layer 403 at a second end of the sixth transmission line 434.

The tuning unit 450 includes first to fifth tuning elements 451-455. The first to fifth tuning elements 451-455 are disposed in a third dielectric layer 404. The first, third, and fifth tuning elements 451, 453, and 455 are located at respective regions in which the second, fourth, and sixth transmission lines 414, 424, and 434 are partly contained, respectively. Particularly, the first ground 401A is located under the first and fifth tuning elements 451 and 455 and the second ground 401B is located under the third tuning element 453. The second and fourth tuning elements 452 and 453 are located above a left or right side of the fourth transmission line 424. The first or second ground 401A or 401B may be located under the second and fourth tuning elements 452 and 454.

According to the line filter of this embodiment, since the grounds 401A and 401B are provided between the transmission lines, the advancing direction of the transmission line 424 can be varied. Accordingly, in the line filter 400 of this embodiment, the advancing direction of the transmission line can be varied without affecting on the adjacent transmission line.

Figure 6:
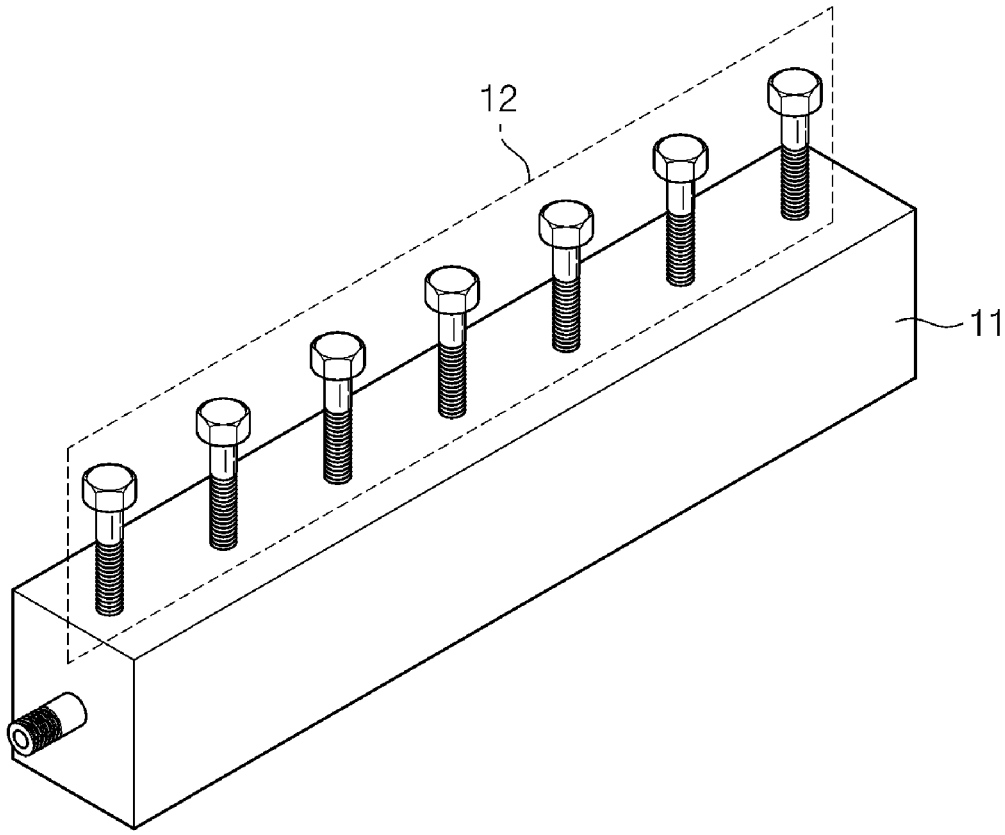
FIG. 6 is a view illustrating the line filter that is housed.

FIG. 6 is a view illustrating the line filter that is housed. Referring to FIG. 6, the line filter includes a housing main body 11 and a tuning unit 12 coupled to the housing main body 11. Here, the housing main body 111 receives one of the line filters 100, 200, 300, and 400 shown in FIGS. 1 to 4. Further, the tuning unit 12 may be identical to that of FIG. 1.

According to the embodiments, since the line filter includes at least one line resonator on at least two stacked dielectric layers, the integration can be easily realized.

Further, since the line filter includes the tuning unit for adjusting the binding amount between the adjacent line resonators, there is no need to make lengths of the adjacent transmission lines that are formed on the same layer same as each other. As a result, the line filter can be easily optimally realized.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A line filter comprising:

a plurality of first line resonators;

a plurality of second line resonators; and an adjustable tuning unit disposed between a first pair of first and second line resonators and a second pair of first and second line resonators, which is adjacent to the first pair, wherein each of the plurality of first line resonators comprises:

a first transmission line arranged in a first direction on a top surface of a first dielectric layer and electrically connected to a ground through a first via that extends through the first dielectric layer; and a second transmission line arranged in a second direction opposite to the first direction on a top surface of a second dielectric layer and electrically connected to the first transmission line through a second via that extends through the second dielectric layer;

wherein each of the plurality of second line resonators comprises a third transmission line arranged in the first direction on a top surface of a third insulation layer and electrically connected to the ground through a third via that extends through the third insulation layer; and wherein the first direction is directed from a first end of the first transmission line, to which the first via is connected, to a second end of the first transmission line, to which the second via is connected.

2. A line filter, comprising:

a plurality of line resonators; and an adjustable tuning unit, an adjustment of which increases or decreases a distance between the adjustable tuning unit and one of the plurality of line resonators, so as to adjust a resonance frequency between an adjacent two of the plurality of line resonators, wherein each of the plurality of line resonators comprises:

a first transmission line extending in a first direction on a top surface of a first dielectric layer and electrically connected to ground through a first via that extends through the first dielectric layer; and a second transmission line extending in a second direction opposite to the first direction on a top surface of a second dielectric layer and electrically connected to the first transmission line through a second via through the second dielectric layer.

3. The line filter of claim 2, wherein the first direction is directed from a first end of the first transmission line, to which the first via is connected, to a second end of the first transmission line, to which the second via is connected.

* * * * *